US008070031B2

(12) United States Patent
Moeller et al.

(10) Patent No.: US 8,070,031 B2
(45) Date of Patent: Dec. 6, 2011

(54) VARIABLE IGNITION DELAY FOR COMBUSTION NAILER

(75) Inventors: Larry Moeller, Schaumburg, IL (US); Hanxin Zhao, Northbrook, IL (US)

(73) Assignee: Illinois Tool Works Inc., Glenview, IL (US)

( * ) Notice: Subject to any disclaimer, the term of this patent is extended or adjusted under 35 U.S.C. 154(b) by 97 days.

(21) Appl. No.: 12/093,924

(22) PCT Filed: Nov. 17, 2006

(86) PCT No.: PCT/US2006/044598
§ 371 (c)(1),
(2), (4) Date: Jun. 19, 2009

(87) PCT Pub. No.: WO2007/061808
PCT Pub. Date: May 31, 2007

(65) Prior Publication Data

US 2009/0314817 A1 Dec. 24, 2009

Related U.S. Application Data

(60) Provisional application No. 60/737,680, filed on Nov. 17, 2005.

(51) Int. Cl.
*B25C 1/08* (2006.01)

(52) U.S. Cl. ..... 227/2; 227/10

(58) Field of Classification Search ..... 227/2, 8, 227/10; 60/632–633
See application file for complete search history.

(56) References Cited

U.S. PATENT DOCUMENTS

| | | | | |
|---|---|---|---|---|
| 4,132,210 | A * | 1/1979 | Long | 123/179.17 |
| 4,403,722 | A | 9/1983 | Nikolich | |
| 4,483,473 | A | 11/1984 | Wagdy | |
| 4,483,474 | A | 11/1984 | Nikolich | |
| 4,522,162 | A | 6/1985 | Nikolich | |
| RE32,452 | E | 7/1987 | Nikolich | |
| 5,197,646 | A | 3/1993 | Nikolich | |
| 5,263,439 | A * | 11/1993 | Doherty et al. | 123/46 SC |
| 5,415,136 | A * | 5/1995 | Doherty et al. | 123/46 SC |
| 5,897,043 | A | 4/1999 | Veoukas et al. | |
| 6,102,270 | A | 8/2000 | Robinson | |
| 6,145,724 | A | 11/2000 | Shkolnikov et al. | |
| 6,223,963 | B1 * | 5/2001 | Aparacio, Jr. | 227/8 |
| 6,318,615 | B1 * | 11/2001 | Walter | 227/10 |
| 6,722,550 | B1 * | 4/2004 | Ricordi et al. | 123/46 SC |
| 6,783,045 | B2 * | 8/2004 | Shima et al. | 227/8 |

(Continued)

*Primary Examiner* — Paul Durand
*Assistant Examiner* — Andrew M Tecco
(74) *Attorney, Agent, or Firm* — Greer, Burns & Crain, Ltd.; Patty Chidiac; Mark W. Croll

(57) ABSTRACT

A combustion-powered fastener-driving tool includes a tool housing, a power source associated with the housing and including a cylinder head, a cylinder and a piston reciprocating in the cylinder, a valve sleeve reciprocating relative to the cylinder, a chamber switch and a trigger switch; the cylinder head, the valve sleeve, the cylinder and the piston combining to define a combustion chamber, the closing of both switches required for initiating an ignition of the power source for driving piston down cylinder. A fan is disposed in the combustion chamber, and a control system includes a control program associated with the housing, connected to the power source, the chamber switch and the trigger switch, and configured for providing a designated ignition delay period after fuel is injected into the combustion chamber and when the chamber switch is closed, the delay period being variable as a function of monitored tool parameters.

11 Claims, 5 Drawing Sheets

U.S. PATENT DOCUMENTS 6,983,871 B2 * 1/2006 Shima et al. ..... 227/8
7,021,251 B2 * 4/2006 Ohmori et al. ..... 123/46 R
7,341,171 B2 3/2008 Moeller et al.
7,487,898 B2 2/2009 Moeller et al.
2004/0182336 A1 9/2004 Ohmori et al.
2005/0173487 A1 8/2005 Moeller et al.

* cited by examiner

VARIABLE IGNITION DELAY FOR COMBUSTION NAILER

RELATED APPLICATION

This application claims priority pursuant to 35 USC §120 based on U.S. Ser. No. 60/737,680 filed Nov. 17, 2005.

TECHNICAL FIELD

The present invention relates generally to fastener-driving tools used to drive fasteners into workpieces, and specifically to combustion-powered fastener-driving tools, also referred to as combustion tools or combustion nailers.

BACKGROUND ART

Combustion-powered tools are known in the art, and exemplary tools produced by Illinois Tool Works of Glenview, Ill., also known as IMPULSE® brand tools for use in driving fasteners into workpieces, are described in commonly assigned patents to Nikolich U.S. Pat. Re. No. 32,452, and U.S. Pat. Nos. 4,522,162; 4,483,473; 4,483,474; 4,403,722; 5,197,646; 5,263,439; 5,897,043 and 6,145,724 all of which are incorporated by reference herein.

Such tools incorporate a tool housing enclosing a small internal combustion engine. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. Such ancillary processes include: mixing the fuel and air within the chamber, turbulence to increase the combustion process, scavenging combustion by-products with fresh air, and cooling the engine. The engine includes a reciprocating piston with an elongated, rigid driver blade disposed within a single cylinder body.

A valve sleeve is axially reciprocable about the cylinder and, through a linkage, moves to close the combustion chamber when a work contact element at the end of the linkage is pressed against a workpiece. This pressing action also triggers a fuel-metering valve to introduce a specified volume of fuel into the closed combustion chamber. Thus, the valve sleeve opens the combustion chamber for venting gases, and closes the combustion chamber for sealing prior to ignition.

In such tools, once fuel is injected into the combustion chamber, the fuel and air are mixed using turbulence created by a rotating fan blade. If the fuel and air are not mixed properly prior to ignition, either a weak combustion cycle or no combustion will occur. Therefore, it is important that sufficient time is provided for mixing to assure repeatable nailer operation and desired performance. Mixing time is defined as the interval from which fuel is injected into the combustion chamber and the fuel and air is uniformly mixed.

The time duration for achieving complete mixture depends on many parameters, including fuel metering time, fuel spray pattern, fuel spray velocity, fan configuration and rotational velocity (RPM), and engine and fuel temperatures. Of these, the most significant are fan RPM, engine temperature and fuel temperature. The faster the fan RPM, the less time is required for mixing due to increased turbulence within the chamber. Considering higher tool and fuel operating temperatures, the gas molecules are more energetic, which in turn reduces available mixing time. In addition, higher fuel cell temperatures increase the pressure of the fuel, which gives the fuel spray/jet greater velocity as it is injected into the combustion chamber, which promotes mixing. The opposite trends of the previous conditions will cause increased required mixing times.

In view of the above conditions, there is a need for an improved combustion nailer configured for monitoring and controlling such parameters, and providing improved tool performance.

DISCLOSURE OF INVENTION

The above-listed needs are met or exceeded by the present combustion nailer featuring a control system for monitoring and adjusting tool operating parameters such as fuel and air mixing times, ignition timing, battery voltage, fuel cell temperatures and/or pressures, and tool and ambient temperatures. Receiving inputs from tool systems, the control system adjusts controllable tool parameters such as fuel/air mix times, and promotes homogeneous fuel/air mixing prior to ignition. As a result of the present system, tool operation is more stable, with nail drive consistency improved. Also, the control system prevents nailer operation if the tool is out of position at any time during the drive cycle.

More specifically, a combustion-powered fastener-driving tool includes a tool housing, a power source associated with the housing and including a cylinder head, a cylinder and a piston reciprocating in the cylinder, a valve sleeve reciprocating relative to the cylinder, a chamber switch and a trigger switch. The cylinder head, the cylinder, the valve sleeve and the piston combine to define a combustion chamber. The closing of both switches is required for initiating an ignition of the power source for driving the piston down the cylinder. A fan is disposed in the combustion chamber, and a control system includes a control program associated with the housing, connected to the power source, the chamber switch and the trigger switch, and configured for providing a designated ignition delay period after fuel is injected into the combustion chamber and when the chamber switch is closed, the delay period being variable as a function of monitored tool parameters. In the present application, the terms mixing delay and ignition delay are used interchangeably.

In another embodiment, a combustion-powered fastener-driving tool is provided and includes a tool housing, a power source associated with the housing including a cylinder head, a cylinder and a piston reciprocating in the cylinder, a valve sleeve reciprocating relative to the cylinder, the cylinder head, the cylinder, the valve sleeve and the piston combining to define a combustion chamber. A chamber switch is closed upon the valve sleeve closing the combustion chamber. The closing of the chamber and a trigger switch is required for initiating an ignition of the power source for driving the piston down the cylinder. A fan is disposed in the combustion chamber and is powered by a fan motor. A control system includes a control program associated with the housing, connected to power source, the fan motor, the chamber switch and the trigger switch, and is configured for providing a designated ignition delay period after fuel metering and the closing of the chamber switch, the delay period being extendable with decreases in at least one of engine temperature, battery voltage, fan motor speed, fuel system pressure, fuel cell temperature and ambient temperature.

In still another embodiment, a combustion-powered fastener-driving tool includes a tool housing, a power source associated with the housing including a cylinder head, a cylinder and a piston reciprocating in the cylinder, a valve sleeve reciprocating relative to the cylinder, a chamber switch and a trigger switch. The cylinder head, the cylinder, the valve sleeve and the piston combine to define a combustion chamber. The closing of both switches is required for initiating an ignition of the power source for powering the piston down the cylinder. A fan is disposed in the combustion chamber. A control system includes a control program associated with the housing, connected to the power source, the act of fuel metering (mechanical or electromechanical), and the chamber switch is configured for providing a designated ignition delay period. The program is configured for aborting the ignition, thereby aborting the power source cycle, if the chamber switch is opened during the ignition delay. For further tool operations, the operator repeats the normal operating sequences of tool operation.

BEST MODE FOR CARRYING OUT THE INVENTION

Figure 1:
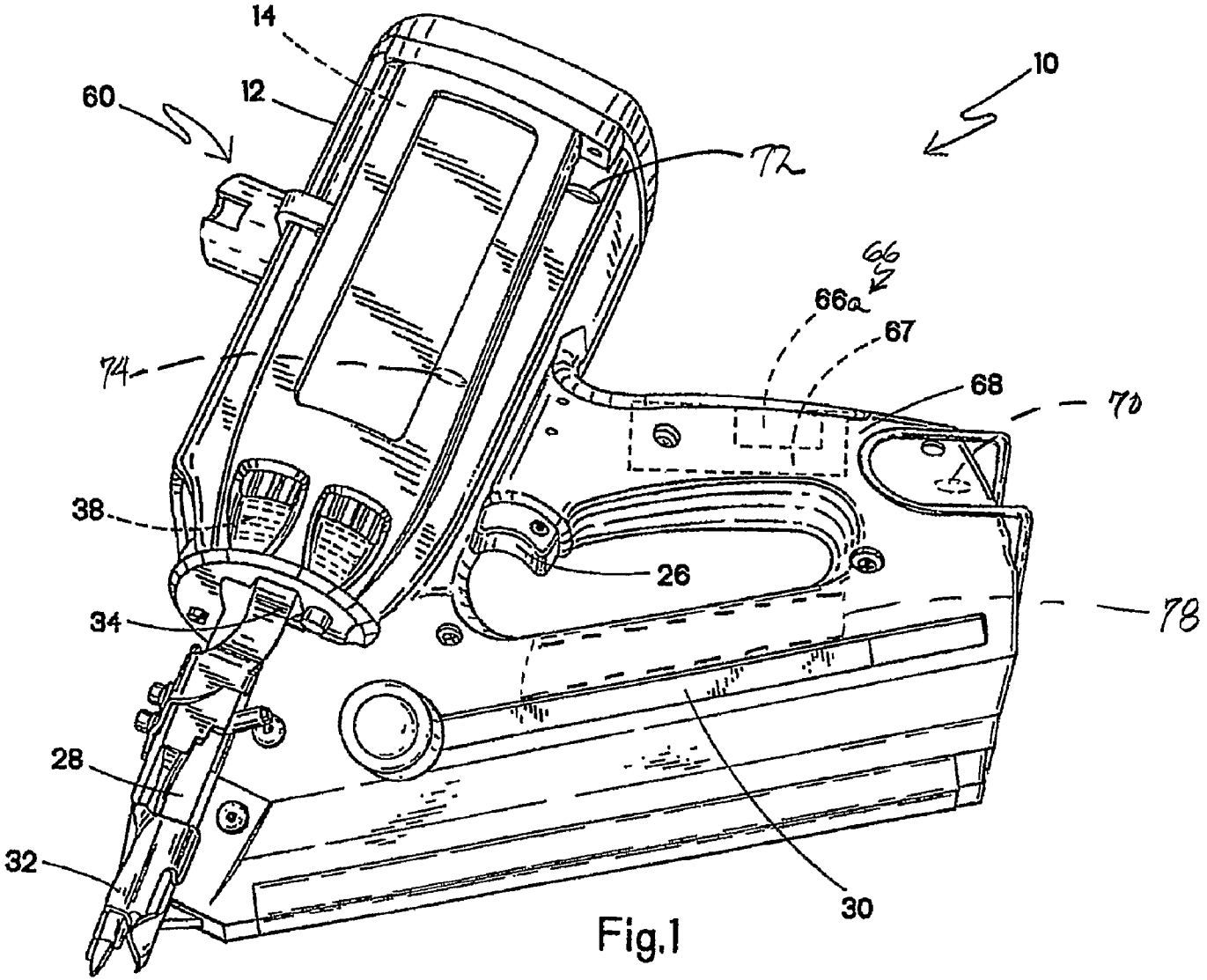
FIG. 1 is a front perspective view of a fastener-driving tool incorporating the present control system.
Figure 2:
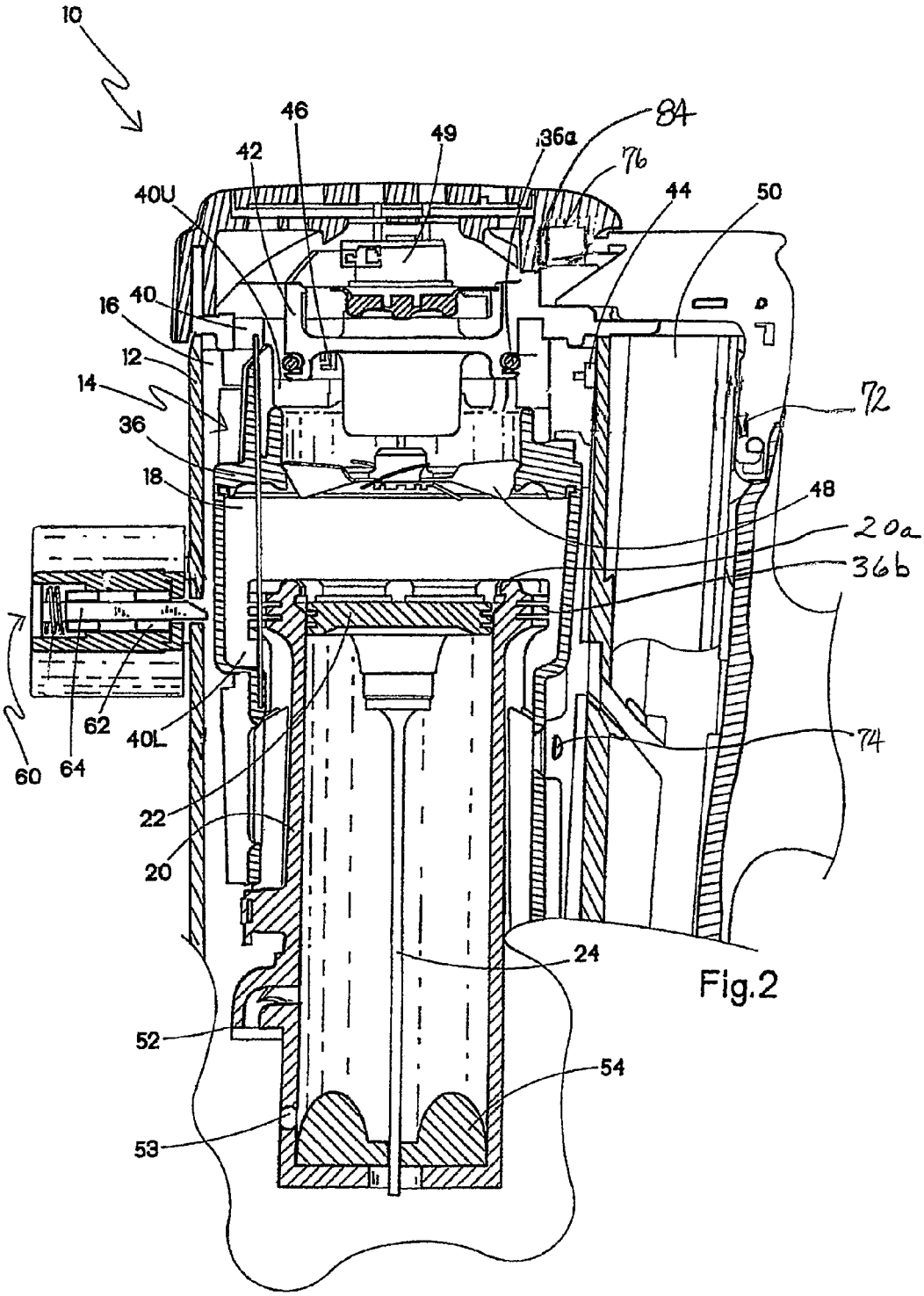
FIG. 2 is a fragmentary vertical cross-section of the tool of FIG. 1 shown in the rest position.

Referring now to FIGS. 1 and 2, a combustion-powered fastener-driving tool incorporating the present invention is generally designated 10 and preferably is of the general type described in detail in the patents listed above and incorporated by reference in the present application. A housing 12 of the tool 10 encloses a self-contained internal power source 14 within a housing main chamber 16. As in conventional combustion tools, the power source 14 is powered by internal combustion and includes a combustion chamber 18 that communicates with a cylinder 20. A piston 22 reciprocally disposed within the cylinder 20 is connected to the upper end of a driver blade 24. As shown in FIG. 2, an upper limit of the reciprocal travel of the piston 22 is referred to as a pre-firing position, which occurs just prior to firing, or the ignition of the combustion gases which initiates the downward driving of the driver blade 24 to impact a fastener (not shown) to drive it into a workpiece.

When the tool is in a sequential operating mode, through depression of a trigger 26, which inherently closes a trigger switch (not shown, the terms trigger and trigger switch are used interchangeably) an operator induces combustion within the combustion chamber 18, causing the driver blade 24 to be forcefully driven downward into a nosepiece 28. The nosepiece 28 guides the driver blade 24 to strike a fastener that had been delivered into the nosepiece via a fastener magazine 30.

Included in the nosepiece 28 is a workpiece contact element 32, which is connected, through a linkage or upper probe 34 to a reciprocating valve sleeve 36, which partially defines the combustion chamber 18. Depression of the tool housing 12 against a workpiece causes the workpiece contact element 32 to move relative to the tool housing 12, from a rest position (FIG. 2) to a pre-firing position. This movement overcomes the normally downward biased orientation of the workpiece contact element 32 caused by a spring 38 (shown hidden in FIG. 1).

In the rest position, the combustion chamber 18 is not sealed, since there is an annular gap 40 separating the valve sleeve 36 and a cylinder head 42, which accommodates a chamber switch or head switch 44 and a spark plug or other spark generator 46. Specifically, there is an upper gap 40U near the cylinder head 42, and a lower gap 40L near the upper end of the cylinder 20. In the preferred embodiment of the present tool 10, the cylinder head 42 also is the mounting point for a cooling fan 48 and a fan motor 49 powering the cooling fan. The fan 48 and at least a portion of the motor 49 extend into the combustion chamber 18 as is known in the art and described in the patents which have been incorporated by reference above. In the pre-firing position the combustion chamber 18 is sealed by virtue of contact between the valve sleeve 36 and combustion chamber seals 36*a* and 36*b*, and is defined by the piston 22, the valve sleeve 36, the cylinder head 42, and a top 20*a* of the cylinder 20.

In the sequential operating mode, firing is enabled when an operator presses the workpiece contact element 32 against a workpiece. This action overcomes the biasing force of the spring 38, causes the valve sleeve 36 to move upward relative to the housing 12, and sealing the combustion chamber 18 until the chamber switch 44 is activated. This operation also induces a measured amount of fuel to be released into the combustion chamber 18 from a fuel canister 50 (shown in fragment).

Upon a pulling of the trigger 26, the spark plug 46 is energized, igniting the fuel and air mixture in the combustion chamber 18 and sending the piston 22 and the driver blade 24 downward toward the waiting fastener. As the piston 22 travels down the cylinder 20, it pushes a rush of air which is exhausted through at least one petal or check valve 52 (FIG. 2). At the bottom of the piston stroke or the maximum piston travel distance, the piston 22 impacts a resilient bumper 54 and at least one vent hole 53 located beyond piston displacement (FIG. 2) as is known in the art. With the piston 22 beyond the exhaust check valve 52, high pressure gasses vent from the cylinder 20. Due to internal pressure differentials in the cylinder 20, the piston 22 is drawn back to the pre-firing position shown in FIG. 2.

To ensure that the piston 22 returns to the prefiring position of FIG. 2 even during relatively rapid rate repetitive firing, the present tool 10 preferably incorporates a lockout device, generally designated 60 and configured for preventing the reciprocation of the valve sleeve 36 from the closed or firing position, to the rest position, until the piston 22 returns to the pre-firing position. This holding or locking function of the lockout device 60 is operational for a specified period of time required for the piston 22 to return to the pre-firing position. Thus, the operator using the tool 10 in a repetitive cycle mode can lift the tool from the workpiece where a fastener was just driven, and begin to reposition the tool for the next firing cycle. With the present lockout device 60, the piston 22 return and the controlled opening of the combustion chamber 18 occur while the tool 10 is being moved toward the next workpiece location.

More specifically, and while other types of lockout devices are contemplated and are disclosed in the co-pending application Ser. No. 11/028,432 incorporated by reference, the exemplary lockout device 60 includes an electromagnet 62 configured for engaging a sliding cam or latch 64 which transversely reciprocates relative to valve sleeve 36 for preventing the movement of the valve sleeve 36 for a specified amount of time. This time period is controlled by a control system 66 (FIG. 1) incorporating a program or circuit 66*a* and embodied in a central processing unit or control module 67 (shown hidden), typically a microprocessor housed in a handle portion 68 (FIG. 1) or other location in the housing 12, as is well known in the art.

Also included in the tool 10 is at least one temperature sensor, such as a thermistor or other device which measures temperature and is connectable to the control system 66 to provide inputs to the control program 66*a*. The present temperature sensors include a first sensor 70 mounted on or associated with the housing 12 as far as effectively possible from the power source 14 to sense ambient temperature or temperature independent of heat generated during combustion. A second sensor 72 is mounted in operational proximity to the fuel cell 50 for sensing the temperature of the fuel cell. As is the case with the sensor 70, it is preferred that the sensor 72 is located sufficiently close to the fuel cell 50 but also far enough from the power source 14 to sense fuel cell temperature independent of power source temperature. A third optional sensor is a power source sensor 74 located in operational proximity to the power source 14, such as on or near the cylinder 20. The tool 10 may be provided with one, two or all three of the above-identified sensors 70-74, all of which are connected to the program 66*a* in a known manner. The location and programming of temperature sensors is disclosed in greater detail in copending U.S. patent application Ser. No. 11/028,020 filed Jan. 3, 2005, which is incorporated by reference. It will be understood that the control system 66 includes the control program 66*a*, the control module 67 and the trigger switch 26, the chamber switch 44, sensors and related circuitry.

The tool 10 may also be optionally equipped with a fuel metering system, designated and shown schematically at 76 (FIG. 2). Such systems are known in the art, and one such system is disclosed in commonly assigned U.S. Pat. No. 6,102,270 which is incorporated by reference. The fuel metering system 76 is in communication with the fuel cell 50 and dispenses measured doses of fuel through a metering valve (not shown) to the combustion chamber 18.

It will be appreciated that the fuel metering system 76 is powered by a battery 78 (shown hidden) and controlled by the control program 66*a*. The battery 78 is also used to power the control system 66 and all electronic operational functions of the tool 10. As is known in the art, the battery 78 may take the form of at least one rechargeable unit or at least one conventional disposable battery.

As is known, the control program 66*a* is operable in either a sequential or a repetitive cycle operating system, and the details of such a system are disclosed in commonly assigned U.S. patent application Ser. No. 11/028,450, published as US Patent Application No. 2005/0173487A1 which is incorporated by reference. In summary, in sequential operation, as described above, the chamber switch 44 must be closed by upward movement of the valve sleeve 38 to the valve sleeve prefiring position before the trigger 26 can be pulled to initiate combustion. In repetitive cycle operation, the user maintains the trigger 26 pulled during tool operation, and each subsequent ignition is initiated by the closing of the chamber switch 44, with every tool actuation against the workpiece.

Figure 3:
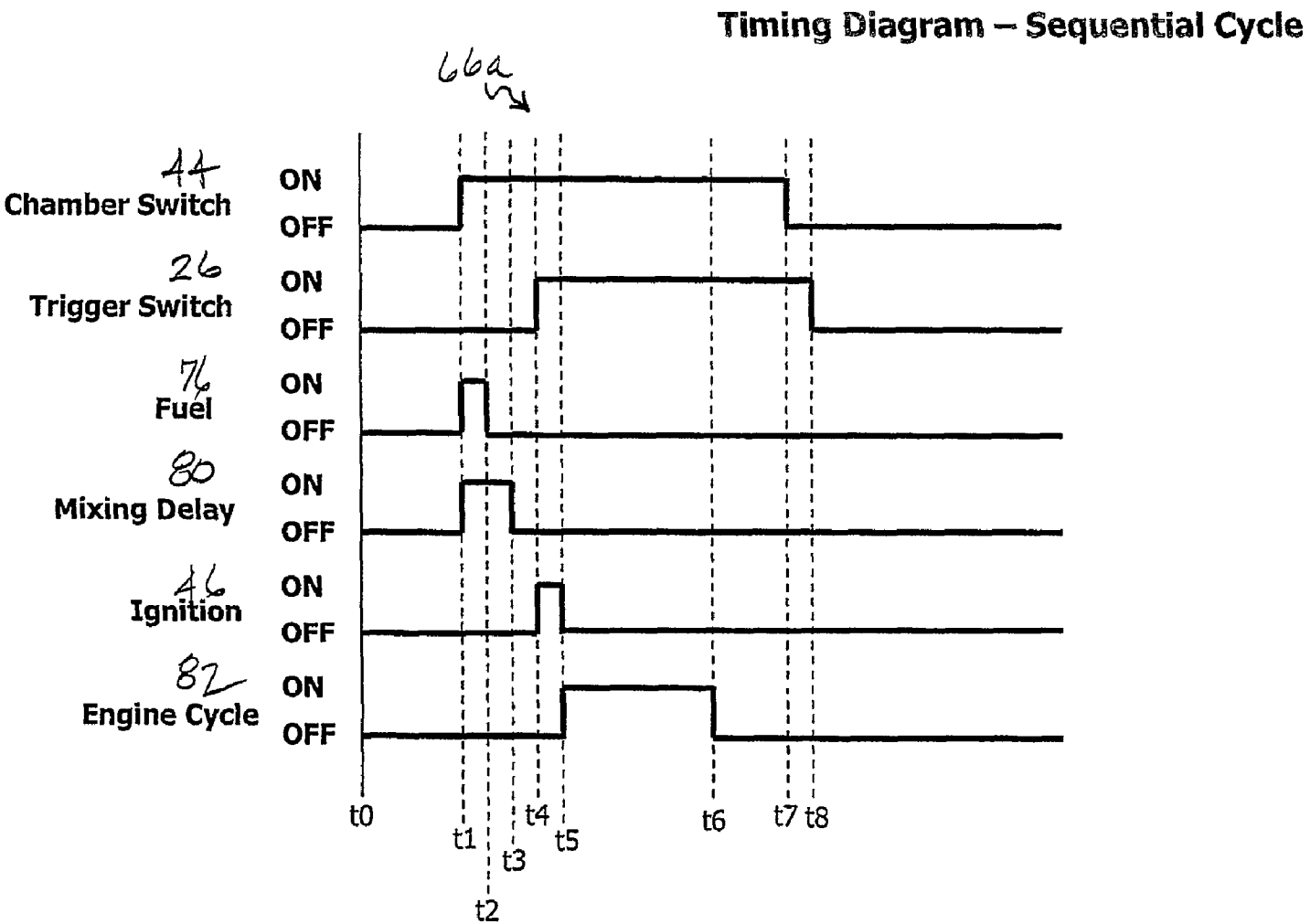
FIG. 3 is a timing chart depicting the operation of the present control system in a sequential cycle of operation.

Referring now to FIG. 3, the present control program 66*a* features a configuration for varying an ignition or mixing delay depending on sensed environmental or tool parameters when the tool is in sequential operation. At t0, the tool 10 is at rest. At t1, the user presses the tool 10 against a workpiece, so that the workpiece contact element 32 slides relative to the nosepiece 28, closing the combustion chamber 18 as well as the chamber switch 44. Simultaneously with the closing of the chamber switch 44, the fuel metering system 76 injects a supply of fuel into the combustion chamber 18, and the control program 66*a* begins a preset mixing delay 80 which delays ignition for a designated amount of time for the fan 48 to mix the fuel/air mixture in the combustion chamber for more efficient combustion. A preferred mixing delay period 80 is in the range of 0-50 msec, but this may vary to suit the environmental and tool parameters. At t2 the process of fuel metering ends, and the rotating fan 48 mixes air and fuel within the combustion chamber 18. At t3 the mixing delay 80 ends, and the tool 10 is ready for ignition.

At t4, the user closes the trigger switch 26, which begins an ignition cycle between t4 and t5. During this time, the control system 66 generates a sufficient electrical charge for activating the spark plug 46. Upon conclusion of the ignition cycle at t5, the engine cycle 82 begins, including ignition of the fuel/air mixture in the combustion chamber 18, movement of the piston 22 and the driver blade 24 down the cylinder 20 to drive a fastener, the exhaust of combustion by-product gases through the valve 52, and the return of the piston 22 to the pre-firing position shown in FIG. 2. The engine cycle continues until t6, during which the trigger switch 26 is held closed by the user. At t7, the user lifts the tool 10 from the workpiece, causing the spring 38 to push the valve sleeve 36 to the open position, opening the chamber switch 44, which also allows recharging of the air in the combustion chamber 18. Lastly, the user releases the trigger switch 26, and the tool 10 resets for the next firing.

Figure 4:
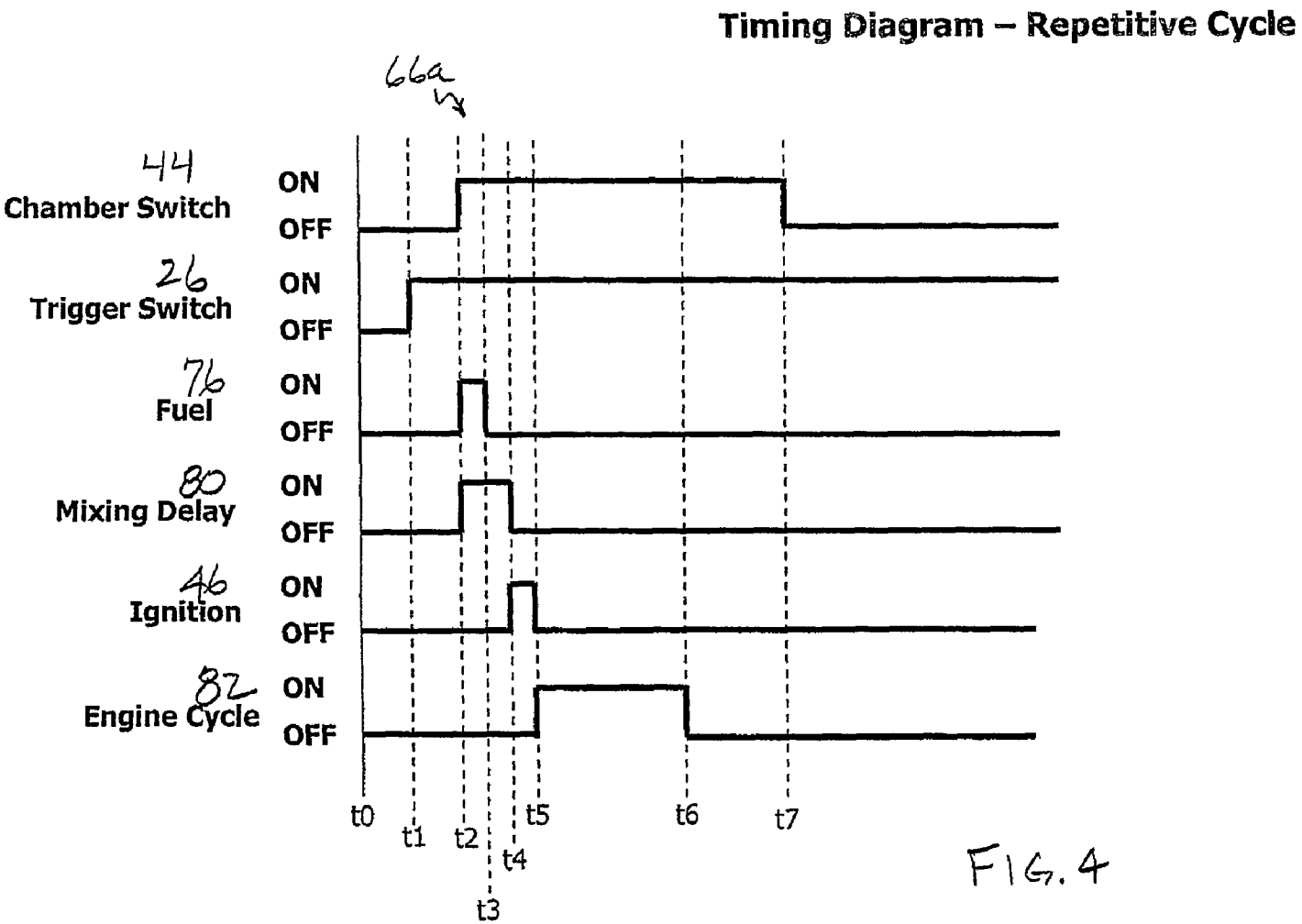
FIG. 4 is a timing chart depicting the operation of the present control system in a repetitive cycle of operation.

Referring now to FIG. 4, the operation of the control program 66*a* is depicted when the tool is in repetitive cycle operation. Again, at t0, the tool is at rest. At t1, the user pulls the trigger 26, closing the associated trigger switch. Next, at t2, the chamber switch 44 is closed and fuel metering 76 begins, as does the mixing delay 80. As is the case in sequential operation, the fuel metering 76 lasts until t3, while the mixing delay 80 lasts until t4. At the conclusion of the mixing delay 80, the ignition cycle begins and the spark plug 46 is activated at t4 and extends until t5.

Similar to the sequential operation depicted in FIG. 3, at the conclusion of the ignition cycle 46, the engine cycle 82 begins at t5 and extends until t6. At t7, the user lifts the tool 10 from the workpiece, and the chamber switch 44 eventually opens at t7. The tool 10 is then ready for another cycle. As is typical in repetitive cycle mode, the trigger switch 26 is held in the closed position between firings.

Figure 5:
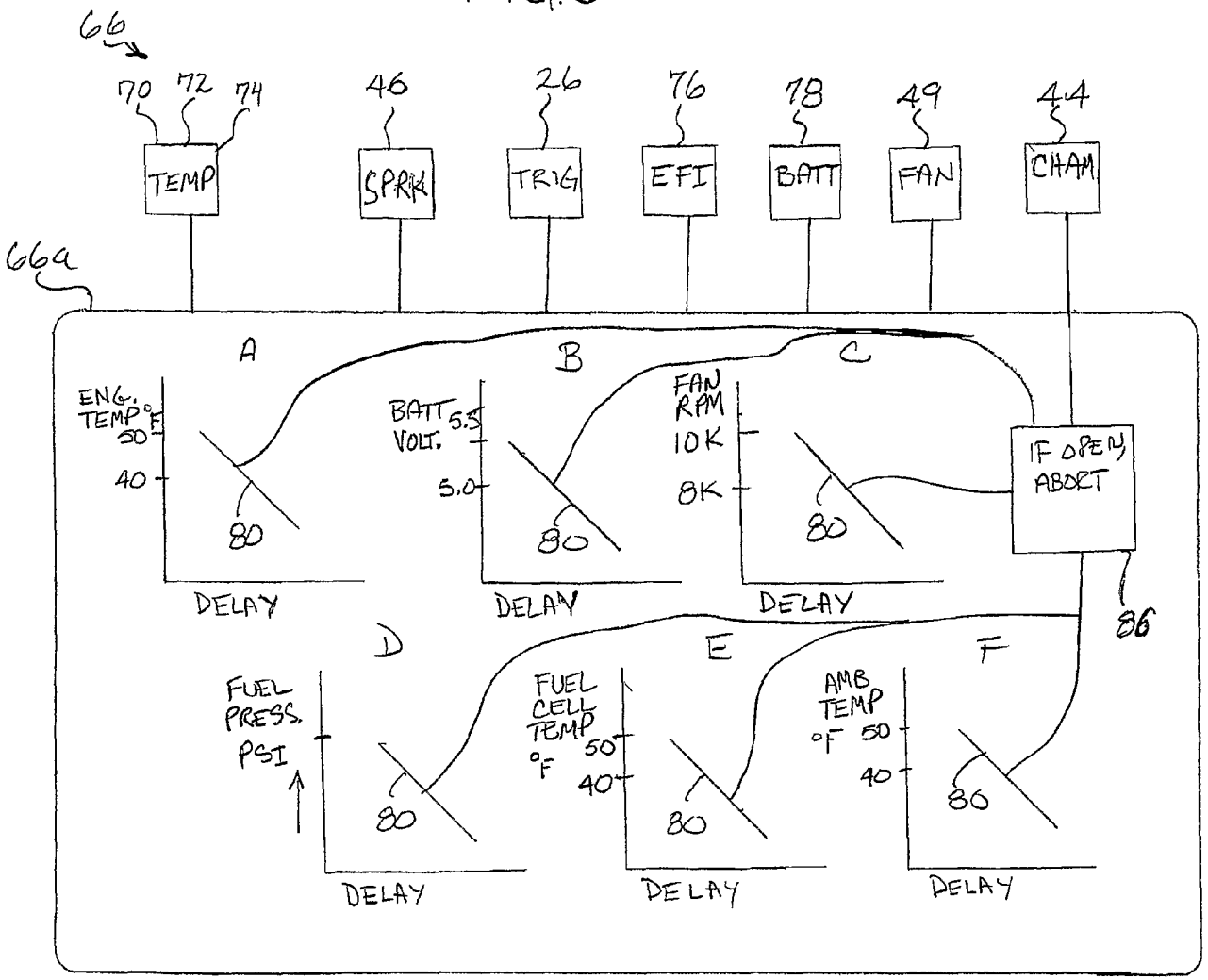
FIG. 5 is a schematic diagram of the inputs to the control system.

Referring to FIG. 5, certain environmental and/or tool operational conditions may influence the efficiency of the mixing in the combustion chamber 18 prior to ignition. These conditions include ambient temperature, fuel cell temperature, power source temperature, battery charge, fan motor speed and fuel pressure. A feature of the present control system 66 is that the control program 66*a* is configured so that the delay period 80 is variable as a function of such monitored tool parameters.

As described above, the temperature sensors 70-74, the chamber switch 44, the trigger switch 26, the fuel metering system 76, the battery 78, the fan motor 49 and the spark plug 46 are all connected to the control program 66*a*. For example, if sensed temperature from any of the sensors 70-74 is less than for example 50° F., the tool 10 is operating under relatively cold conditions, and additional mixing time is desirable for more efficient combustion. Thus, the program 66*a* is configured so that the delay 80 is increased as the sensed temperature falls below 50° F. as seen in graphs A, E and F. The delay 80 may be increased with decreasing temperatures as the temperature falls progressively below 50° F. It will be understood in all of the graphs A-F that the duration of the delay 80 may vary to suit the situation.

Also, referring now to graph B, as the battery 78 loses its charge, the fan motor 49 and other tool components may operate more slowly, also requiring a relatively longer mixing delay 80 for effective combustion. More specifically, as battery voltage drops below 5.5 volts DC in a 6 volt system, the delay 80 will be progressively longer. It is contemplated that the voltage threshold may vary with the application. Similarly, as seen in graph C, as fan motor speed measured in revolutions per minute (RPM) drops below a designated amount, preferably 10,000 RPM, the mixing delay 80 will progressively increase. The RPM threshold for extension of the delay 80 may also vary with the application.

Further, referring to graph D, as fuel pressure decreases as measured by the program 66*a* through a pressure transducer 84 connected to the fuel metering system 76 (FIG. 2), or the fuel cell temperature sensor 72, the mixing delay 80 also progressively increases. A suitable fuel pressure transducer or sensor 84 is described in commonly owned U.S. Pat. No. 6,722,550, which is incorporated by reference. As the fuel cell temperature is reduced lower than 50° F., the fuel cell pressure correspondingly lowers below 100 psi which reduces the fuel metering velocity and increases the mixing time. It should be noted that the program 66*a* may be configured so that combinations of the above relationships represented by the graphs A-F are included, or only one or all of the relationships built into the program.

Another feature of the control program 66*a* is depicted at box 86, in which, during monitoring of the chamber switch 44, the control program determines that the chamber switch opens, thus opening the combustion chamber 18 during the mixing delay 80, the ignition will be aborted. As known, the chamber switch 44 is typically positioned to close when the combustion chamber 18 is approximately sealed and when the workpiece contact element 32 is close to full actuation. In tool use applications such as sheathing, where the user is driving fasteners at a rapid pace, the user can potentially withdraw the tool 10 from the work surface during the mixing cycle or prior to ignition. This can potentially lead to variable height nails in the workpiece, and is unacceptable to the user. Also, this condition can be aggravated when long mix times are required, such as on the order of 50 msec or longer. The abort feature 86 provides more consistent tool results for the user and will alert the user to adjust his operating speed.

Thus, it will be seen that the present combustion nailer control system monitors and adjusts mixing delay periods depending on monitored tool functions, and aborts tool operation when out of sequence conditions occur. The present tool control system extends mixing delay as a function of sensed temperatures, fuel pressures, fan RPM and/or battery voltage. As a result, tool misfires are prevented and tool operation is more reliable. Furthermore, tool performance is more consistent.

While a particular embodiment of the present variable ignition delay for a combustion nailer has been described herein, it will be appreciated by those skilled in the art that changes and modifications may be made thereto without departing from the invention in its broader aspects and as set forth in the following claims.

The invention claimed is:

1. A combustion-powered fastener-driving tool, comprising:

a tool housing:

a power source associated with said housing and including a cylinder head, a cylinder and a piston reciprocating in said cylinder, a valve sleeve reciprocating relative to said cylinder, a chamber switch and a trigger switch, said cylinder head, said cylinder, said valve sleeve and said piston combining to define a combustion chamber, the closing of both said switches required for initiating an ignition of said power source for driving said piston down said cylinder;

a fan disposed in said combustion chamber; and a control system including a control program associated with said housing, connected to said power source, said chamber switch and said trigger switch, and providing a designated ignition delay period after fuel is injected into the combustion chamber and when the chamber switch is closed, and initiating combustion in the combustion chamber at the end of said delay period, said control system varying said delay period based on monitored tool parameters.

2. The tool of claim 1, further including at least one temperature sensor for monitoring at least one of ambient temperature, engine temperature and fuel cell temperature, said at least one temperature sensor being connected to said control program, said control program extending said delay period with decreasing temperatures.

3. The tool of claim 2 wherein said delay period is extended when at least one of said ambient temperature, said engine temperature and said fuel cell temperature falls below 50° F.

4. The tool of claim 1 further including a battery for powering said control system, wherein said control system monitors voltage of said battery, and said control program is configured for extending said delay period when said battery voltage is below a preset level.

5. The tool of claim 1 wherein said fan is powered by a fan motor, said control system monitors operation of said fan motor, and said program is configured for varying said delay period as a function of speed of said fan motor.

6. The tool of claim 1 wherein said control program monitors said chamber switch and is configured for aborting said ignition if said chamber switch is opened during said ignition delay.

7. The tool of claim 1 wherein said control program is configured so that said ignition delay begins upon activation of a fuel metering system configured for said injection of fuel into said combustion chamber.

8. A combustion-powered fastener-driving tool, comprising:

a tool housing;

a power source associated with said housing including a cylinder head, a cylinder and a piston reciprocating in said cylinder, a valve sleeve reciprocating relative to said cylinder, said cylinder head, said cylinder, said valve sleeve and said piston combining to define a combustion chamber, a chamber switch being closed upon said valve sleeve closing said combustion chamber and a trigger switch, the closing of both said switches required for initiating an ignition of said power source for powering said piston down said cylinder;

a fan disposed in said combustion chamber and powered by a fan motor; and a control system including a control program associated with said housing, connected to said power source, said fan motor, said chamber switch and said trigger switch, and providing a designated ignition delay period after fuel metering and closing of said chamber switch, and initiating combustion in said combustion chamber at the end of said delay period, said control system extending said delay period with decreases in at least one of engine temperature, battery voltage, fan motor speed, fuel system pressure, fuel cell temperature and ambient temperature.

9. The tool of claim 8 wherein said control program monitors said chamber switch and is configured for aborting said ignition if said chamber switch is opened during said ignition delay.

10. A combustion-powered fastener-driving tool, comprising:

a tool housing;

a power source associated with said housing including a cylinder head, a cylinder and a piston reciprocating in said cylinder, a valve sleeve reciprocating relative to said cylinder, a chamber switch and a trigger switch, said cylinder head, said cylinder, said valve sleeve and said piston combining to define a combustion chamber, the closing of both said switches required for initiating an ignition of said power source for powering said piston down said cylinder;

a fan disposed in said combustion chamber;

a control system including a control program associated with said housing, connected to said power source and a source of fuel metering, said chamber switch and said trigger switch, and providing a designated ignition delay period after closing of said chamber switch, and initiating combustion in said combustion chamber at the end of said delay period, said program being configured for aborting said ignition and an operational cycle of said power source if said chamber switch is opened during said ignition delay; and wherein said control program is configured for varying said delay period as a function of at least one of engine temperature, battery voltage, fan motor speed, fuel system pressure, fuel cell temperature and ambient temperature.

11. A combustion-powered fastener-driving tool, comprising:

a tool housing:

a power source associated with said housing and including a cylinder head, a cylinder and a piston reciprocating in said cylinder, a valve sleeve reciprocating relative to said cylinder, a chamber switch and a trigger switch, said cylinder head, said cylinder, said valve sleeve and said piston combining to define a combustion chamber, the closing of both said switches required for initiating an ignition of said power source for driving said piston down said cylinder;

a fan disposed in said combustion chamber;

a control system including a control program associated with said housing, connected to said power source, said chamber switch and said trigger switch, and configured for providing a designated ignition delay period after fuel is injected into the combustion chamber by a fuel cell and when the chamber switch is closed, said delay period being variable as a function of monitored tool parameters; and a fuel metering system connected to said fuel cell and configured for dispensing fuel to said combustion chamber, said control system configured for monitoring fuel pressure emitted by said fuel metering system and varying said delay period as a function of fuel pressure.

* * * * *